US009668550B2

(12) United States Patent
Seo et al.

(10) Patent No.: US 9,668,550 B2
(45) Date of Patent: Jun. 6, 2017

(54) WEARABLE DEVICE

(71) Applicants: Samsung Electronics Co., Ltd., Suwon-si (KR); Seneka Co., Ltd., Suwon-si (KR)

(72) Inventors: Ho-seong Seo, Suwon-si (KR); Pil-je Cho, Suwon-si (KR); Young-woo Huh, Suwon-si (KR); Si-wan Kim, Suwon-si (KR)

(73) Assignees: SAMSUNG ELECTRONICS CO., LTD., Suwon-si (KR); SENEKA CO., LTD., Suwon-si (KR)

( * ) Notice: Subject to any disclaimer, the term of this patent is extended or adjusted under 35 U.S.C. 154(b) by 238 days.

(21) Appl. No.: 14/487,750

(22) Filed: Sep. 16, 2014

(65) Prior Publication Data

US 2015/0089974 A1 Apr. 2, 2015

(30) Foreign Application Priority Data

Sep. 27, 2013 (KR) ..... 10-2013-0115545

(51) Int. Cl.

| | |
|---|---|
| ***A44C 5/08*** | (2006.01) |
| ***A44C 5/00*** | (2006.01) |
| *A44C 5/12* | (2006.01) |

(52) U.S. Cl.

CPC ..... *A44C 5/08* (2013.01); *A44C 5/0076* (2013.01); *A44C 5/12* (2013.01)

(58) Field of Classification Search

CPC ..... A44C 5/08; A44C 5/0076; A44C 5/12; A44C 5/025; A44C 5/10; A44C 5/102; A44C 5/105; A44C 5/107; A44C 5/0061; A44C 5/16; G04G 17/02; G04G 17/083; H05K 5/0017; H04M 1/0268; H01L 51/0097; G02F 1/133308; F16F 1/027; Y02E 10/549

USPC ..... 63/8, 11

See application file for complete search history.

(56) References Cited

U.S. PATENT DOCUMENTS

| | | | | |
|---|---|---|---|---|
| 326,606 A * | 9/1885 | Tingley | ..... | A44C 5/0092 63/11 |
| 6,425,494 B1 * | 7/2002 | Woods, II | ..... | B65D 81/3879 215/12.1 |
| 7,347,019 B1 * | 3/2008 | Shaw | ..... | F16F 1/025 40/607.01 |

(Continued)

FOREIGN PATENT DOCUMENTS

| | | | | |
|---|---|---|---|---|
| CH | WO 2012156804 A1 * | 11/2012 | ..... | A44C 5/025 |
| FR | 2792507 A1 * | 10/2000 | ..... | A44C 5/12 |
| GB | 2047514 A * | 12/1980 | ..... | A44C 5/025 |

*Primary Examiner* — Jack W Lavinder

(74) *Attorney, Agent, or Firm* — Staas & Halsey LLP

(57) ABSTRACT

A wearable device that may transform between an annularly bent state and a flat state is provided. The wearable device includes a plurality of segment members including a top portion and a bottom portion having a shorter length than the top portion; a plurality of connecting members that are disposed to correspond to the plurality of segment members, wherein each of the plurality of connecting members is connected to be mutually rotatable with two segment members disposed respectively on both sides thereof; a bistable spring that is supported on a plurality of segment members to provide elasticity in a direction into the annularly bent state and retentivity of the flat state; and a flexible display device that is supported on the top portion of the plurality of segment members.

20 Claims, 15 Drawing Sheets

(56) References Cited

U.S. PATENT DOCUMENTS

| | | | | |
|---|---|---|---|---|
| 8,590,857 | B2 * | 11/2013 | Chen | H05K 5/0217 24/3.1 |
| 2013/0044215 | A1 * | 2/2013 | Rothkopf | G06F 1/163 348/143 |
| 2014/0055924 | A1 * | 2/2014 | Baek | H05K 5/0017 361/679.01 |

* cited by examiner

WEARABLE DEVICE

CROSS-REFERENCE TO RELATED APPLICATIONS

This application claims the priority benefit of Korean Patent Application No. 10-2013-00115545, filed on Sep. 27, 2013, in the Korean Intellectual Property Office, the disclosure of which is incorporated herein in its entirety by reference.

BACKGROUND

1. Field

Embodiments relate to wearable devices that are capable of transformations between an annularly bent state and a flat state.

2. Description of the Related Art

Portable wearable devices (hereinafter, mobile devices), such as communication devices, game devices, multimedia devices, portable computers, and imaging devices include display devices displaying image information and input devices such as keypads. Mobile devices commonly have foldable structures such that the mobile devices may be folded into a smaller size for portability. In such mobile devices, two bodies are connected by a foldable structure. Since conventional display devices have structures that are not foldable, the conventional display devices may be disposed in any one of the two bodies. Accordingly, mobile devices having a foldable structure may be difficult to apply to wide display devices.

Recently, as bendable flexible display devices are developed, research is being conducted about applying flexible display devices to wearable devices that may be worn on a human body, for example, on the wrist or the like, due to the transformation capabilities of the wearable devices between an annularly bent state and a flat state.

SUMMARY

One or more embodiments may provide wearable devices that may stably support flexible display devices.

One or more embodiments may provide wearable devices that may have an improved external appearance.

In an aspect of one or more embodiments, there is provided a wearable device that is configured for a transformation between an annularly bent state and a flat state, the wearable device which may include a plurality of segment members including a top portion and a bottom portion having a shorter length than the top portion; a plurality of connecting members that may be disposed to correspond to the plurality of segment members, wherein each of the plurality of connecting members may be connected to be mutually rotatable with two segment members disposed respectively on both sides thereof; a bistable spring that is supported on the plurality of segment members to provide elasticity in a direction into the annularly bent state and retentivity maintaining the flat state; and a flexible display device that is supported on the top portion of the plurality of segment members.

Each of the plurality of segment members may include a connecting pin.

Each of the plurality of connecting members may include: a center hole in which the connecting pin of a corresponding reference segment member among the plurality of segment members is inserted; and first and second guide slots in which connecting pins of two rotational segment members among the plurality of segment members disposed next to the reference segment member are inserted, wherein the first and second guide slots guide bottom portions of the two rotational segment members to be rotated in approaching/separating directions with respect to the bottom portion of the reference segment member.

The first and second guide slots may have an arc shape in which a center thereof is located on a neutral line of the flexible display device.

Each of the plurality of segment members may include: an extended portion that is inwardly stepped from an external surface of the segment member and extends to be overlapped with a neighboring segment member disposed one side of the segment member; and a sunken portion that is disposed on an opposite side of the extended portion and is sunken from an internal surface of the segment member to receive an extended portion of another neighboring segment member disposed on the other side of the segment member.

Each of the plurality of segment members may include: a top cover in which the top portion and the connecting pin may be provided, wherein the connecting member may be coupled with the top cover; and a bottom cover in which the bottom portion, the extended portion, and the sunken portion may be provided, wherein the bottom portion may be coupled with the top cover.

At least one of one end and the other end of the bistable spring may be a free end.

At least one of the one end and the other end of the bistable spring may be adjustably connected to a corresponding segment member in a length direction.

The bistable spring may be fixed on any one of the plurality of segment members.

The plurality of segment members may include a slot through which the bistable spring may pass.

The slot may include a top supporting portion and a bottom supporting portion, which may respectively support a top portion and a bottom portion of the bistable spring, and a gap between the top supporting portion and the bottom supporting portion of the slot may be greater at both ends than a center portion in an alignment direction of the plurality of the segment members.

The bottom supporting portion of the slot may include inclination supporting portions that extend from both ends to the center portion in the alignment direction of the segment members and may be upwardly inclined towards the top supporting portion.

In an aspect of one or more embodiments, there is provided a wearable device including: a body including a plurality of segment members that may be connected sequentially to be rotatable, wherein the body may transform between an annularly bent state and a flat state; a flexible display device supported on the body; a bistable spring that may provide elasticity in a direction of bending into the annularly bent state and retentivity to maintain the flat state; and slots provided in the plurality of segment members to pass the bitable spring therethrough, wherein the slots may include a top supporting portion and a bottom supporting portion, each of which may support a top surface and a bottom surface of the bistable spring; wherein a gap between the top supporting portion of the slot and the bottom supporting portion of the slot may be greater at both ends than a center portion in an alignment direction of the plurality of segment members.

The bottom supporting portion of the slot may include inclination supporting portions that extend from both ends to the center portion in the alignment direction of the segment members and may be upwardly inclined towards the top supporting portion of the slot.

At least one of one end and the other end of the bistable spring may be a free end.

Each of the plurality of segment members may include a top portion and a bottom portion that may be shorter than the top portion, and the plurality of segment members may be rotatable in a direction in which bottom portions of the segment members approach/separate.

The wearable device may further include: a plurality of connecting members that may be disposed to correspond to the plurality of segment members, wherein each of the plurality of segment members may be connected to be mutually rotatable with two segment members disposed respectively on both sides thereof, wherein each of the plurality of segment members may include a connecting pin, and each of the plurality of connecting members may include: a center hole in which the connecting pin of a corresponding reference segment member among the plurality of segment members is inserted; and first and second guide slots in which connecting pins of two rotational segment members among the plurality of segment members disposed next to the reference segment member are inserted, wherein the first and second guide slots guide bottom portions of the two rotational segment members to be rotated in approaching/separating directions with respect to the bottom portion of the reference segment member.

The first and second guide slots may have an arc shape in which a center thereof is located on a neutral line of the flexible display device.

Each of the plurality of segment members may include: an extended portion that is inwardly stepped from an external surface of the segment member and extends to be overlapped with a neighboring segment member disposed one side of the segment member; and a sunken portion that is disposed on an opposite side of the extended portion and is sunken from an internal surface of the segment member to receive an extended portion of another neighboring segment member disposed on the other side of the segment member.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
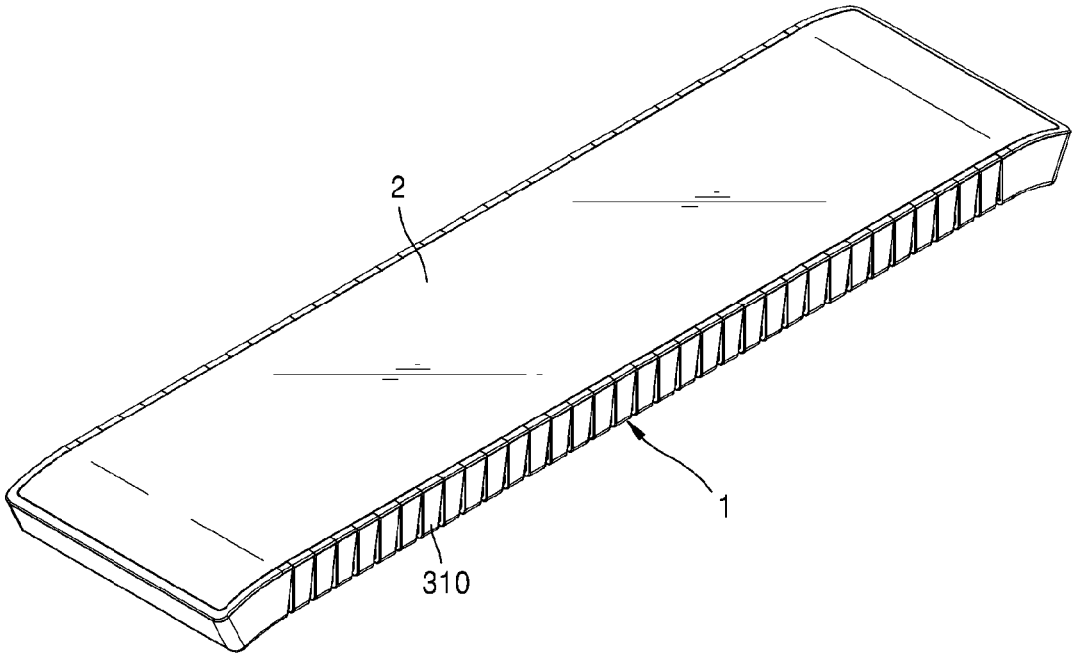
FIG. 1 is an external perspective view of a wearable device according to an embodiment.

Reference will now be made in detail to embodiments, examples of which are illustrated in the accompanying drawings, wherein like reference numerals refer to like elements throughout. In this regard, embodiments may have different forms and should not be construed as being limited to the descriptions set forth herein. Accordingly, embodiments are merely described below, by referring to the figures, to explain aspects of the present disclosure. Expressions such as "at least one of," when preceding a list of elements, modify the entire list of elements and do not modify the individual elements of the list.

Hereinafter, embodiments of a wearable device are described in detail with reference to the drawings. Size and thickness of each component may be exaggerated for clarity of the description.

Figure 2:
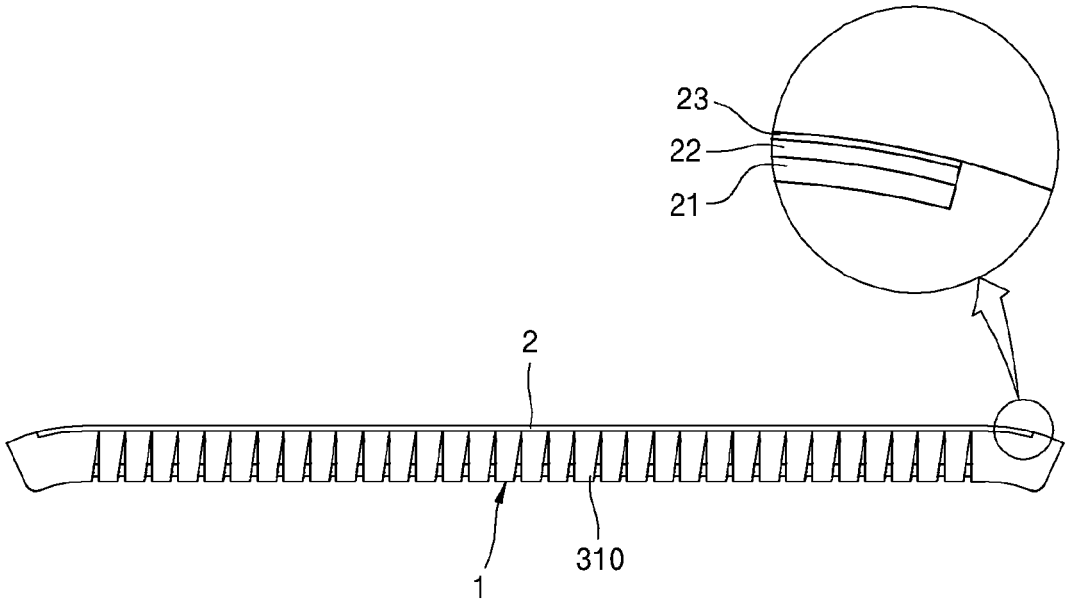
FIG. 2 is a side view of the wearable device shown in FIG. 1 in a flat state, according to an embodiment.
Figure 3:
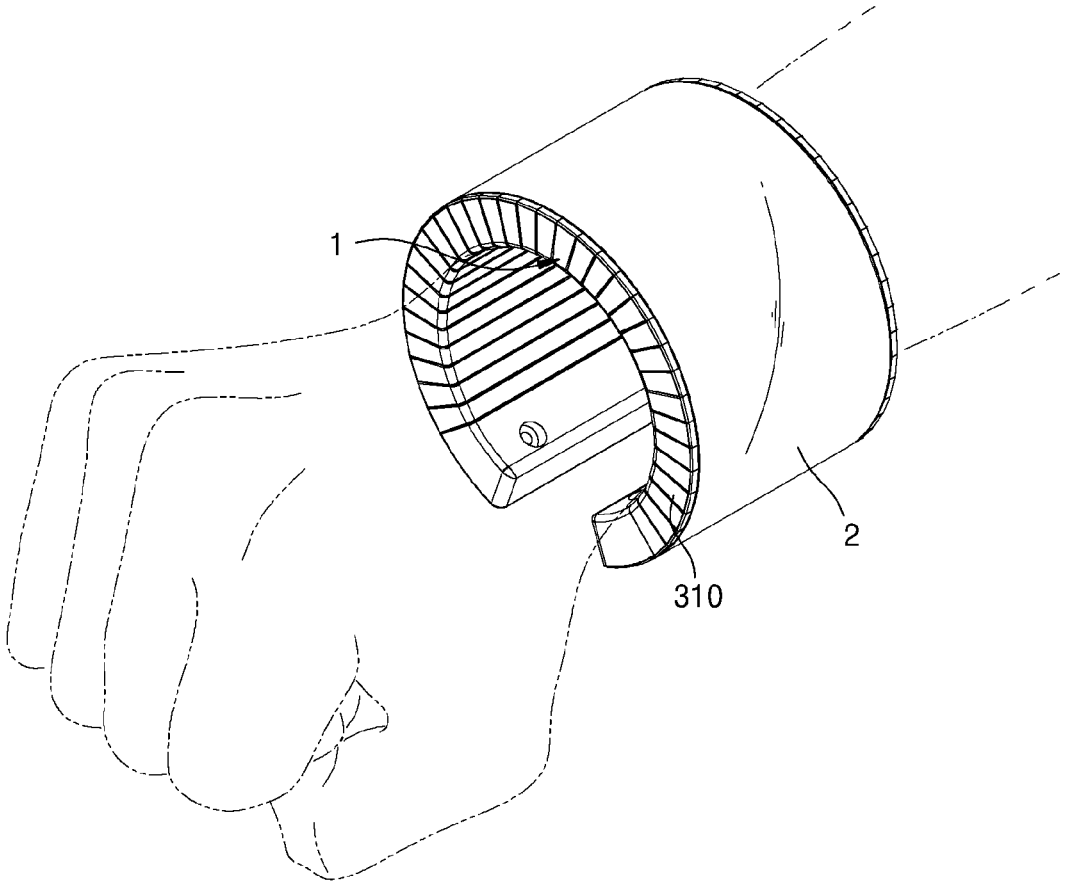
FIG. 3 is a side view of the wearable device shown in FIG. 1 in a bent state, according to an embodiment.

FIG. 1 is an external perspective view of a wearable device according to an embodiment, FIG. 2 is a side view of the wearable device shown in FIG. 1 in a flat state, according to an embodiment, and FIG. 3 is a side view of the wearable device shown in FIG. 1 in an annularly bent state, according to an embodiment.

Referring to FIGS. 1 to 3, the wearable device includes a body 1 that may be transformed between an annularly bent state and a flat state and a flexible display device 2 supported on a top surface of the body 1. The wearable device may be a portable mobile device such as a communication device, a game device, a multimedia device, a portable computer, or an imaging device. However, the wearable device does not need to be a device including the flexible display device 2. For example, the wearable device according to an embodiment may be applied to all types of devices including a flexible flat member supported on the body 1.

The flexible display device 2 may include a flexible display panel 21 that displays an image as illustrated in FIG. 2 and a transparent protection panel 23 disposed on an outer side of the flexible display panel 21. Also, the flexible display device 2 may further include a touch panel 22 as an input unit. The touch panel 22 may be disposed between the transparent protection panel 23 and the flexible display panel 21. Also, the flexible display device 2 may further include various optical panels or optical films.

The body 1 may include a processing unit (not shown) and an input-output unit (not shown) that perform functions according to the purpose of a wearable device. When the wearable device is a multimedia device for watching images or listening to music, the processing unit may include an image/audio information processing unit. When the wearable device is a communication device, the processing unit may include a communication module. The input-output unit may include an image/audio input and output unit and an operating unit (not shown) for user operation. The operating unit may be realized by the touch panel 22 integrated in the flexible display device 2.

As shown in FIG. 3, the wearable device may be annularly bent, wherein the body 1 supports the flexible display device 2 from an inner surface of the flexible display device 2 to be annularly bent with a curvature. As the wearable device is annularly bent, the wearable device may be worn on a human body, for example, on a wrist, as illustrated in FIG. 3.

For transformations between the flat state and the annularly bent state, the body 1 may include a plurality of segment members 310 sequentially connected to be rotatable.

Figure 4:
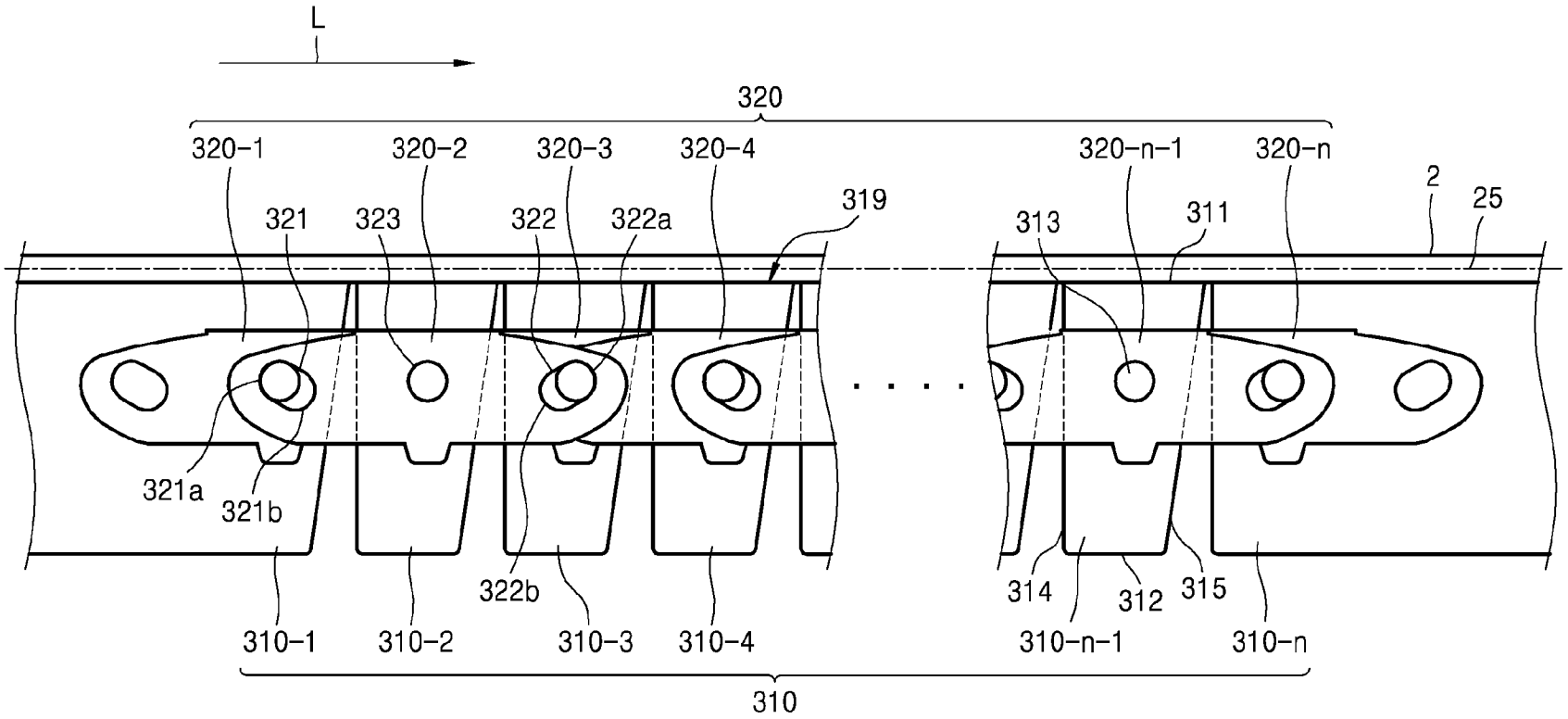
FIG. 4 is a side view of a body of a wearable device in a flat state according to an embodiment.

FIG. 4 is a side view of the body 1 in a flat state according to an embodiment. Referring to FIG. 4, the body 1 includes a plurality of segment members 310 aligned in a length direction L and a plurality of connecting members 320 that sequentially connect the plurality of segment members 310 to be rotatable. The segment members 310 include a top portion 311 and a bottom portion 312. The flexible display device 2 is supported on the top portion 311. The top portion 311 and the bottom portion 312 respectively refer to an outer surface and an inner surface of the body 1, based on a direction of bending. A length of the bottom portion 312 is shorter than a length of the top portion 311. The segment member 310 includes a first side portion 314 and a second side portion 315 that connect the top portion 311 and the bottom portion 312. The first side portion 314 is disposed opposite to the second side portion 315 of a neighboring segment member 310. The first side portion 314 forms a wedge shape with the second side portion 315 of a neighboring segment member 310. The top portions 311 of the plurality of segment members 310 form a support surface 319 supporting the flexible display device 2.

The connecting member connects two segment members (rotational segment members) disposed respectively on both sides of their corresponding segment member (a reference segment member), such that the two rotational segment members are connected to be rotatable with respect to the reference segment member. For this, connecting pins 313 are provided on the reference segment member and the rotational segment members. On the connecting member 320, a center hole 323 is provided, in which a connecting pin 313 of the reference segment member is inserted, and first and second guide slots 321 and 322, in which connecting pins 313 of the rotational segment members are inserted, are provided respectively on both sides of the center hole 323. The first and second guide slots 321 and 322 guide the rotational segment members by having the reference segment member in the center, such that the bottom portions 312 of the rotational segment members disposed on both sides of the reference segment member rotate in approaching/separating directions with respect to the bottom portion 312 of the reference segment member.

For example, a connection member 320-2 connects rotational segment members 310-1 and 310-3 that are respectively disposed on both sides of the reference segmented member 310-2 to the corresponding reference segment member 310-2 such that the rotational segment members 310-1 and 310-3 are rotatable with respect to the reference segment member 310-2. A connecting pin 313 of the reference segment member 310-2 is inserted into a center hole 323 of the connecting member 320-2. The connecting pins 313 of the rotational segment members 310-1 and 310-3 are inserted into the first and second guide slots 321 and 322 of the connecting member 320-2, respectively. The first guide slot 321 includes a first portion 321*a* that corresponds to a flat state and a second portion 321*b* that corresponds to an annularly bent state. Similarly, the second guide slot 322 includes a first portion 322*a* that corresponds to a flat state and a second portion 322*b* that corresponds to an annularly bent state.

When the body 1 is in a flat state or a bent state, the flexible display device 2 is supported on the support surface 319 that is formed by the top portions 311 of the plurality of segment members 310. When the body 1 is transformed into a flat state, a length of a neutral line (FIG. 4: 25), which is, for example, located at the center of a thickness of the flexible display device 2, is uniformly maintained to minimize stress applied to the flexible display device 2. For this, the first and second guide slots 321 and 322 may have an arc shape, in which a center thereof is located on the neutral line 25. In case a length of the neutral line 25 when the body 1 is in an annularly bent state is longer than a length of the neutral line 25 when the body 1 is in a flat state, tensile strength may be applied to the flexible display device 2, such that the flexible display device 2 may be damaged. Alternatively, in case a length of the support surface 319 when the body 1 is in an annularly bent state is shorter than a length of the support surface 319 when the body 1 is in a flat state, the flexible display device 2 may be lifted off from the support surface 319 and may be bent unevenly.

For example, when the reference segment member 310-2 is used as a reference, the first guide slot 321 of the corresponding connecting member 320-2 may be elongated along a pathway of an arc centered on an intersection between an extended line of the second side portion 315 of the rotational segment member 310-1 and the neutral line 25 or an intersection between the first side portion 314 of the reference segment member 310-2 and the neutral line 25. The extended line of the second side portion 315 of the rotational segment member 310-1 and the extended line of the first side portion 314 of the reference segment member 310-2 may meet the neutral line 25 at an intersection, wherein the first guide slot 321 of the connecting member 320-2 may extend along the pathway of the arc centered on the intersection. Also, the second guide slot 322 of the connecting member 320-2 may extend along a pathway of an arc centered on an intersection between an extended line of the second side portion 315 of the reference segment member 310-2 or an intersection between an extended line of the first side portion 314 of the rotational segment member 310-3 and the neutral line 25. The extended line of the second side portion 315 of the reference segment member 310-2 and the extended line of the first side portion 314 of the rotational segment member 310-3 and the neutral line 25 meet at an intersection, wherein the second guide slot 322 of the connecting member 320-2 may extend along a pathway of an arc centered on the intersection. According to the features described above, a length of the neutral line 25 of the flexible display device 2 may not change when the body 1 is in a bent state or in a flat state.

Segment members 310-1 and **310-*n* are disposed on the outermost portion in the length direction L. only segment members 310-2 and 310-*n*-1 are respectively neighboring the segment members 310-1 and 310-*n*. Each of connecting members 320-1 and 320-*n* corresponding to the segment members 310-1 and 310-*n* may only include the second guide slot 322 and the first guide slot 321, respectively. However, when manufacturing the wearable device, the connecting members 320-1 to 320-*n* may be the same to reduce the types of components. In this case, only the second guide slot 322 of the connecting member 320-1 and the connecting pin 313 of the reference segment member 310-2 may be connected and only the first guide slot 321 of the connecting member 320-*n* and the connecting pin 313 of the segment member 310-*n*-1** may be connected.

Figure 8:
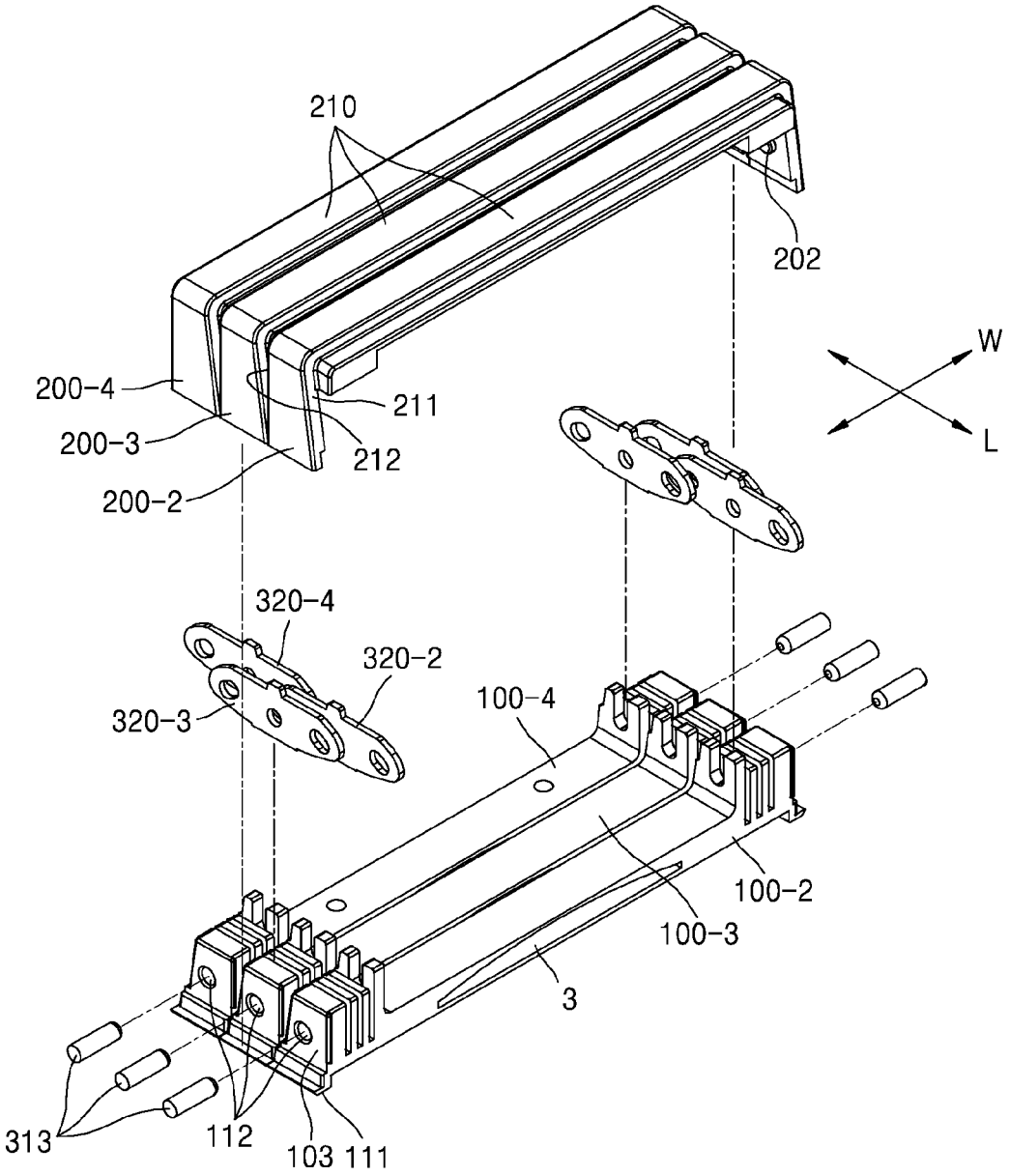
FIG. 8 is an exploded perspective view showing a connection between a top cover and a bottom cover as an embodiment of a segment member.

FIG. 4 illustrates a case in which the connecting members 320-1 to **320-*n* overlap; however, as illustrated in FIG. 8, the connecting members 320-1 to 320-*n*** may be disposed in a zigzag manner in a width direction (W).

When the wearable device is completely flat as illustrated in FIG. 4, each of the connecting pins 313 of the rotational segment members 310-1 and 310-3 may be disposed on the first portions **321*a* and 322*a* of the first and second guide slots 321 and 322 of the connecting member 320-2, in other words, on portions disposed away from the center hole 323. In this state, even when force is applied to bend the body 1 in an opposite direction from a bending direction, the body 1 may not bend because the connecting pins 313 are confined to the first portions 321*a* and 322*a* of the first and second guide slots 321 and 322**.

When external force is applied to bend the body 1 in a bending direction, the segment members 310-1 to **310-*n* may form a triplet pair, such that two rotational segment members disposed respectively on both sides of the reference segment member are rotated along the first and second guide slots 321 and 322 of the connecting members corresponding to the reference segment members. In this regard, the connecting pins 313 of the two rotational segment members disposed respectively on both sides of the reference segment member are guided by the first and second guide slots 321 and 322**.

Figure 5A:
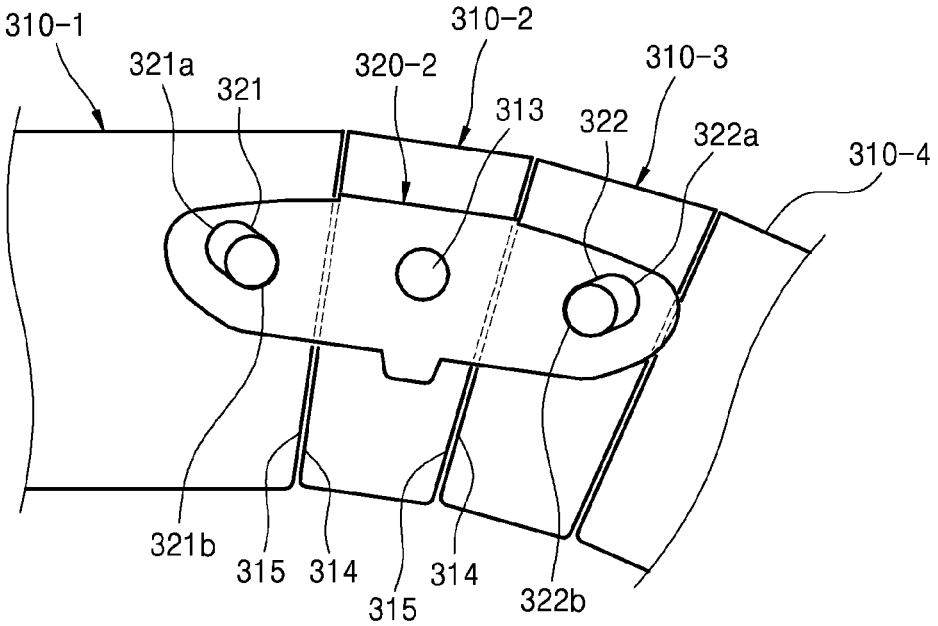
FIG. 5A shows an embodiment of a connection between segment members and connecting members when a body is bent.
Figure 5B:
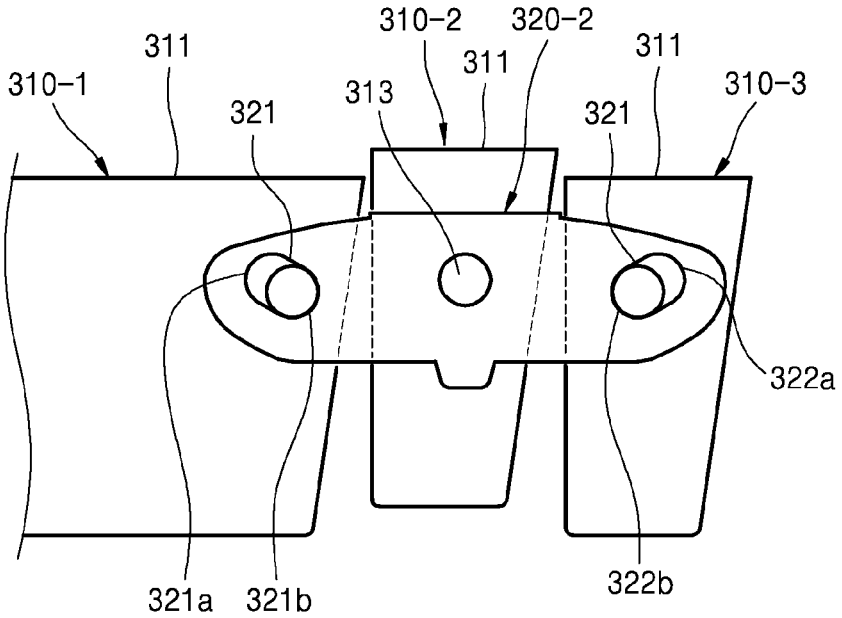
FIG. 5B shows a side view of a Comparative Example of a connection between segment members and connecting members when a body is bent.

FIG. 5A shows an embodiment of a connection between rotational segment members 310-1 to 310-3 and a connecting member 320-2 when the body 1 is bent. FIG. 5B shows a side view of a Comparative Example of a connection between assembly segment members 310-1 to 310-3 and a connecting member 320-2 when the body 1 is folded.

Referring to FIG. 5A, the rotational segment members 310-1 and 310-3, respectively disposed on both sides of the reference segment member 310-2 are rotated along the first and second guide slots 321 and 322 that are disposed on the connecting member 320-2. The rotation of the rotational segment members 310-1 and 310-3 may occur until the connecting pins 313 of the rotational segment members 310-1 and 310-3 reach the second portions **321*b* and 322*b* of the first and second guide slots 321 and 322. When the connecting pins 313 of the rotational segment members 310-1 and 310-3 reach the second portions 321*b* and 322*b* of the first and second guide slots 321 and 322, the rotational segment members 310-1 and 310-3** may not rotate any more.

Due to the features described above, each of the plurality of segment members 310 functions as a reference segment member, which acts as a reference for a rotation of rotational segment members disposed respectively on both sides thereof, such that the body 1 may be annularly bent as shown in FIG. 3.

When the assembly segment member 310-1 acts as a reference segment member, a neighboring segment member 310-2 is guided to be rotated in an arc direction along the second guide slot 322 of the connecting member 320-1 and when the segment member 310-3 acts as a reference segment member, the segment members 310-2 and 310-4 disposed respectively on both sides of the segment member 310-3 are guided to be rotated in an arc direction along the first and second guide slots 321 and 322 of the connecting member 320-3.

When all of the segment members 310-1 to **310-*n* do not act as a reference segment member, in other words, when any one of the plurality of segment members 310-1 to 310-*n* does not act as a reference segment member, for example, the segment member 310-2 disposed at the center, as illustrated in FIG. 5B, acts as a reference, such that the segment members 310-1 and 310-3 disposed respectively on both sides of the segment member 310-2 may move in parallel without being rotated along the first and second guide slots 321 and 322. Then, a curvature of the top portion 311, which supports the flexible display device 2, may become irregular, such that a portion of the flexible display device 2 may be bent into a large curvature, and thus, the flexible display device 2** may be damaged.

The body 1 according to an embodiment includes the segment members 310-1 to **310-*n*, each of which acts as a reference segment member. Thus, the segment members 310-1 to 310-*n* are mutually confined, such that the segment members 310-1 to 310-*n* sequentially rotate along the first and second guide slots 321 and 322 of the corresponding connecting members 320. Accordingly, the support surface 319 formed by the top portions 311 of the plurality of segment members 310** may have a uniform curvature in an annularly bent state.

Figure 6:
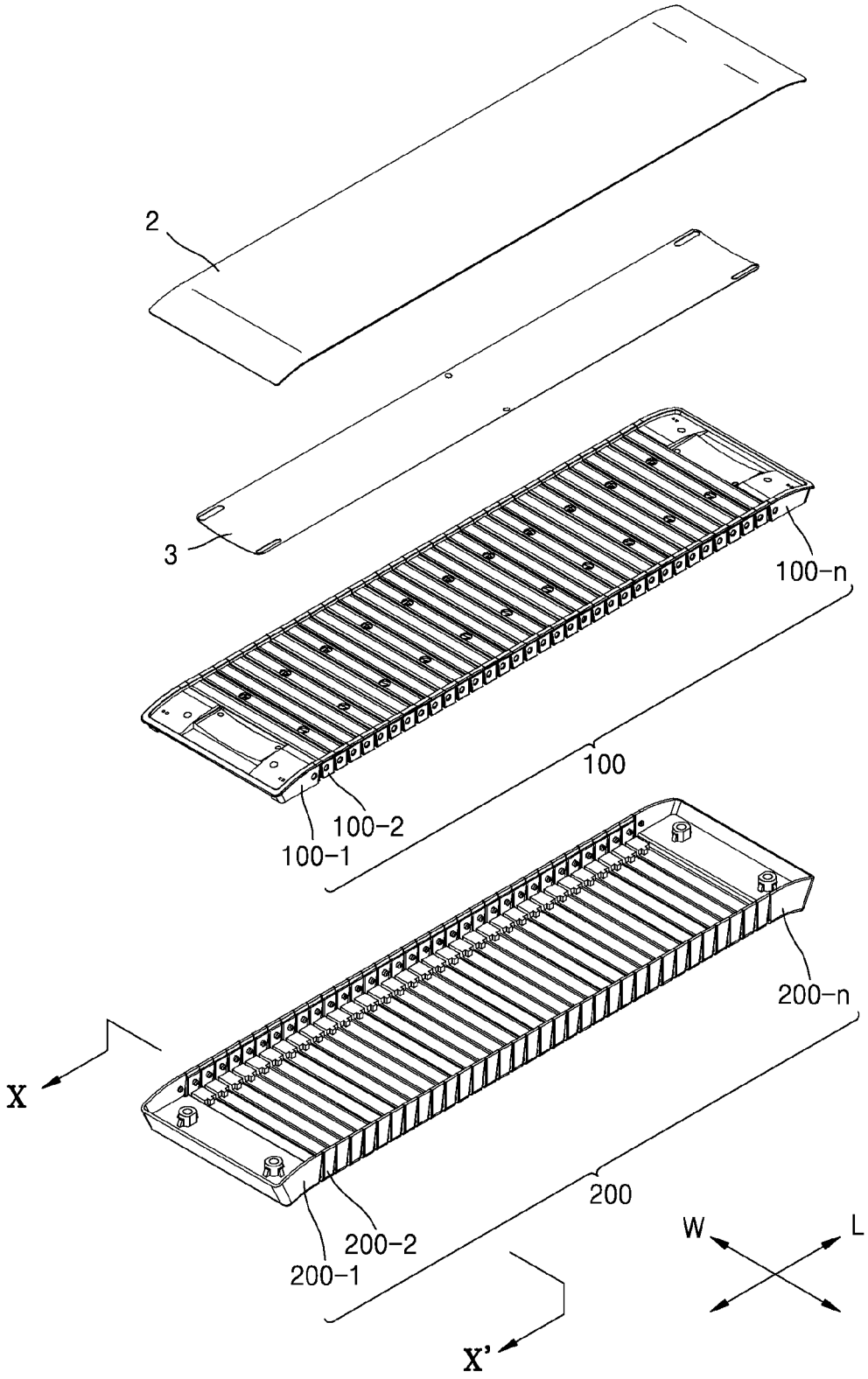
FIG. 6 is an exploded perspective view of a wearable device according to an embodiment.
Figure 7:
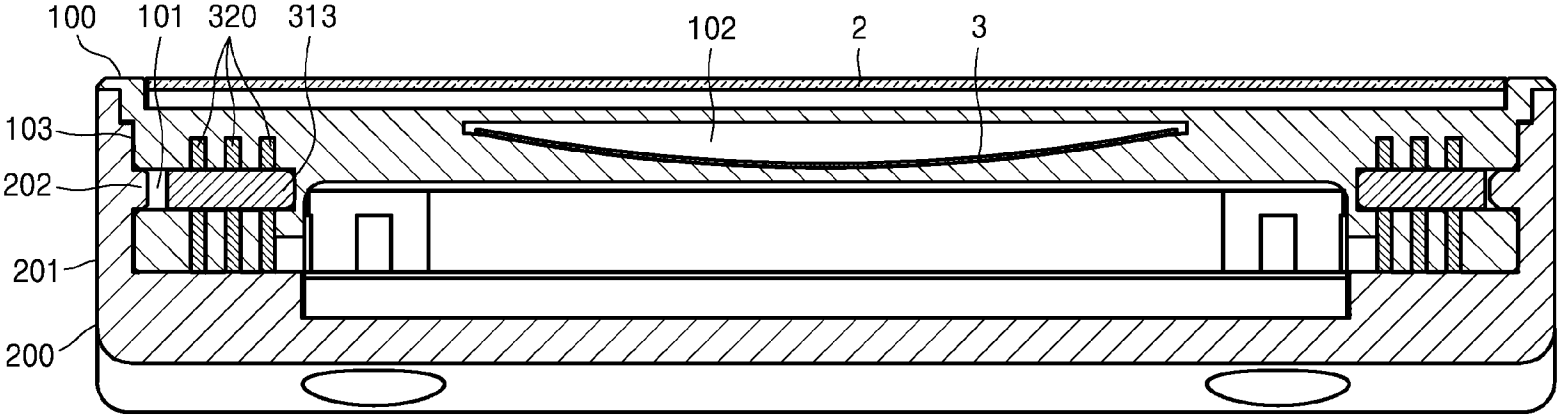
FIG. 7 is a cross-sectional view taken along line X-X' of FIG. 6.

FIG. 6 is an exploded perspective view of a wearable device according to an embodiment. FIG. 7 is a cross-sectional view taken along line X-X' of FIG. 6.

Referring to FIG. 6, the wearable device includes a body 1, a flexible display device 2 coupled to a top surface of the body 1, and a bistable spring 3 provided across the body 1.

The body 1 includes a plurality of top covers 100 and a plurality of bottom covers 200 corresponding to the top covers 100, respectively. The plurality of top covers 100 and the plurality of bottom covers 200 may be mutually coupled to form the plurality of segment members 310 illustrated in FIG. 4. For example, the segment members 310-1 to **310-*n* illustrated in FIG. 4 are formed, in which top covers 100-1 to 100-*n* and bottom covers 200-1 to 200-*n*** are mutually coupled.

Referring to FIG. 7, a protruding pin 202, which inwardly protrudes, is provided on both walls 201 of the bottom cover 200. A concave portion 101 that receives the protruding pin 202 may be provided on the top cover 100. While slightly spread both walls 201 of the bottom cover 200 outwardly, the protruding pin 202 is pushed into the concave portion 101 to combine the top cover 100 to the bottom cover 200. A method of combining the top cover 100 and the bottom cover 200 illustrated in FIG. 7 is given as an example and the scope of embodiments are not limited thereto. For example, although not illustrated in the drawings, the top cover 100 and the bottom cover 200 may be combined by a fixing member, such as a screw.

FIG. 8 is an exploded perspective view showing a connection between a top cover 100 and a bottom cover 200. FIG. 8 illustrates top covers 100-2, 100-3, and 100-4 and bottom covers 200-2, 200-3, and 200-4 respectively corresponding to segment members 310-2, 310-3, and 310-4, according to an embodiment. Referring to FIG. 8, top portions 111 of the top covers 100-2, 100-3, and 100-4 correspond to top portions 311 of the segment members 310-2, 310-3, and 310-4, respectively. Bottom portions 210 of the bottom covers 200-2, 200-3, and 200-4 correspond to bottom portions 312 of the segment members 310-2, 310-3, and 310-4, respectively. Also, the first and second side portions 211 and 212 of the bottom covers 200-2, 200-3, and 200-4 correspond to the first and second side portions 314 and 315 of the segment members 310-2, 310-3, and 310-4.

Connecting members 320-2, 320-3, and 320-4 are coupled to the top covers 100-2, 100-3, and 100-4 by using connecting pins 313 to form the segment members 310-2, 310-3, and 310-4 such that the segment members 310-2, 310-3, and 310-4 are capable of being mutually rotated (configured for mutual rotation). Insertion holes 112, through which the connecting pins 313 are inserted, are formed in the top covers 100-2, 100-3, and 100-4, respectively. The connecting members 320-2, 320-3, and 320-4, which respectively correspond to the top covers 100-2, 100-3, and 100-4, are disposed in a perpendicular direction (a width direction W) to an alignment direction of the top covers 100-2, 100-3, and 100-4, and then the connecting pins 313 are inserted into the insertion holes 112, such that the top covers 100-2, 100-3, and 100-4 and the connecting members 320-2, 320-3, and 320-4 are coupled together.

Referring back to FIG. 7, the connecting pins 313 are deeply inserted into the insertion holes 112, such that a space of the insertion hole 112 between a side wall 103 and a terminal end of the connecting pin 313 may be used as a concave portion 101 that receives the protrusion pin 202 of the bottom cover 200. Accordingly, a structure of the top cover 100 may be simplified.

The segment members 310-1 to 310-*n* may have a shape in which the interior of the wearable device is not externally exposed while the body 1 is in a flat state or an annularly bent state. For this, the segment members 310-1 to 310-*n* have a structure (sunken portion 234 of FIGS. 9A to 9D) which receives a portion (an extended portion 232 of FIGS. 9A to 9D) of the neighboring segment members 310-1 to 310-*n* in the length direction L. For example, the structure described above may be formed on the bottom covers 200 that form the segment members 310.

Figure 9A:
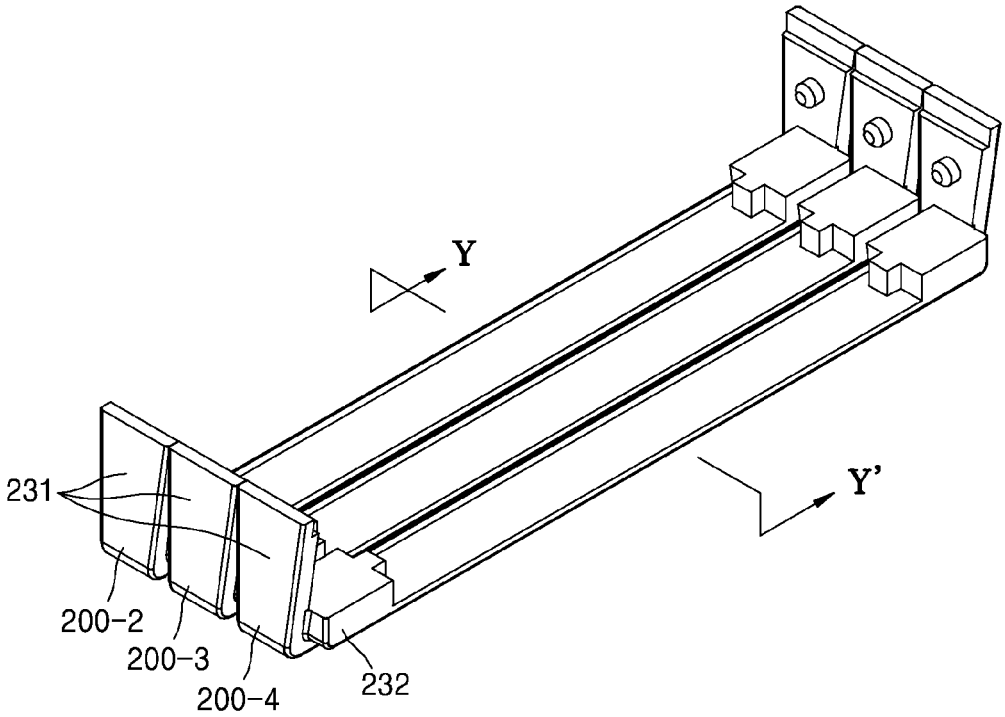
FIG. 9A is a perspective view of a bottom cover according to an embodiment.
Figure 9B:
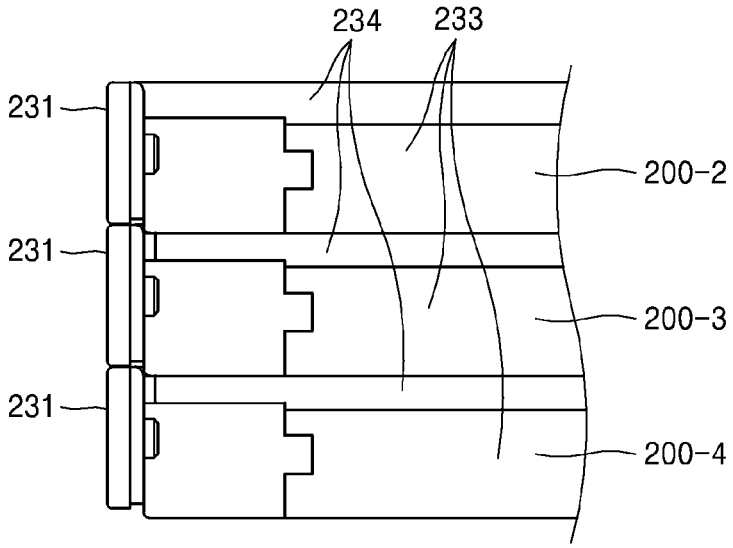
FIG. 9B is a plan view of FIG. 9A.
Figure 9C:
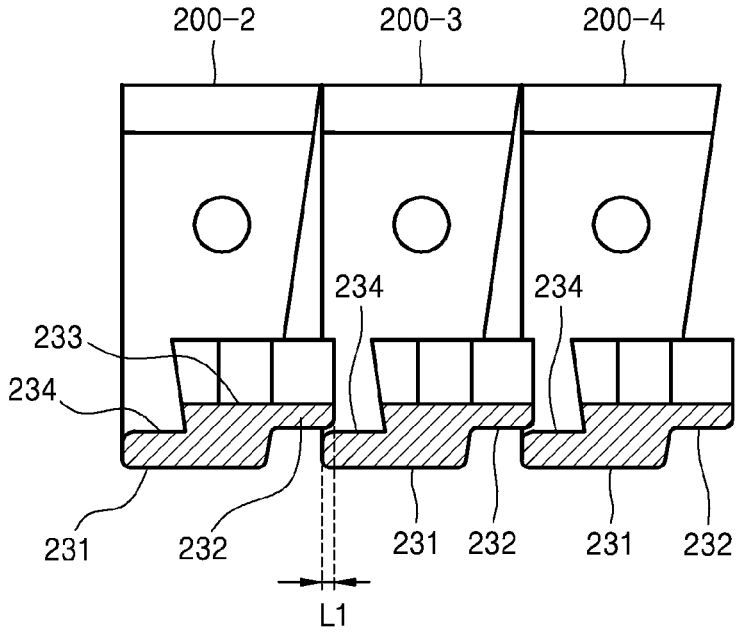
FIG. 9C is a cross-sectional view taken along line Y-Y' of FIG. 9A, wherein a body is in a completely flat state.
Figure 9D:
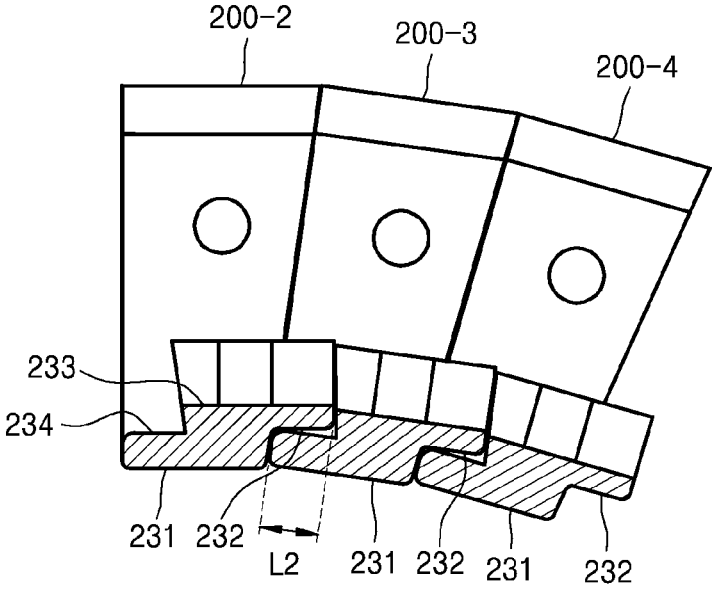
FIG. 9D is a cross-sectional view taken along line Y-Y' of FIG. 9A, wherein a body is completely in a annularly bent state.

FIG. 9A is a perspective view of a bottom cover 200 according to an embodiment. FIG. 9B is a plan view of FIG. 9A. FIG. 9C is a cross-sectional view taken along line Y-Y' of FIG. 9A, wherein the body 1 is in a completely flat state. FIG. 9D is a cross-sectional view taken along line Y-Y' of FIG. 9A, wherein the body 1 is in a completely bent state.

Referring to FIGS. 9A to 9C, each of the bottom covers 200-1 to 200-*n* includes an extended portion 232 that is inwardly stepped from an external surface 231 and extends to be overlapped with a neighboring bottom cover disposed on one side in the length direction L. For example, the extended portion 232 may extend from each second side portion 315 of the bottom covers 200-1 to 200-*n* towards a first side portion 314 of the neighboring bottom cover. Also, each of the bottom covers 200-1 to 200-*n* includes a sunken portion 234 that is disposed on an opposing side of the extended portion 232 in the length direction L, in other words, on a side of the first side portion 314, and is sunken from an internal surface 233 to receive an extended portion 232 of another neighboring bottom cover disposed on another side in the length direction L. Accordingly, a gap between two neighboring bottom covers may be covered by the extended portion 232.

The extended portion 232 of the bottom covers 200-1 to 200-*n* and the sunken portions 234 of other neighboring bottom covers 200-1 to 200-*n* maintain a state in which at least some portions thereof overlap in the length direction L when the bottom covers 200-1 to 200-*n* are in a flat state or annularly bent state. For example, FIGS. 9A to 9C illustrate three bottom covers 200-2, 200-3, and 200-4. The extended portions 232 of the bottom covers 200-2 and 200-3 are disposed in the sunken portions 234 of the bottom covers 200-3 and 200-4. An overlapping length of the extended portion 232 and the sunken portion 234 is L1 when the body 1 is in a completely flat state. Referring to FIG. 9D, the extended portions 232 of the bottom covers 200-2 and 200-3 are disposed in the sunken portions 234 of the bottom covers 200-3 and 200-4 when the body 1 is in an annularly bent state, wherein an overlapping length is L2, which is longer than L1. As described above, at least one portion of the extended portion 232 is disposed in the sunken portion 234, when the body 1 is in a flat state or an annularly bent state and thus, a gap does not form between neighboring bottom covers 200. Accordingly, the inside of the wearable device is not externally exposed. Due to the features described above, the appearance of the wearable device may be improved and the risk of breakdown caused by mingling of impurities may be reduced.

The bistable spring 3 may be provided across the body 1. The bistable spring 3 is a spring that is capable of (configured for) elastic transformation between a flat state and an annularly bent state.

Figure 10A:
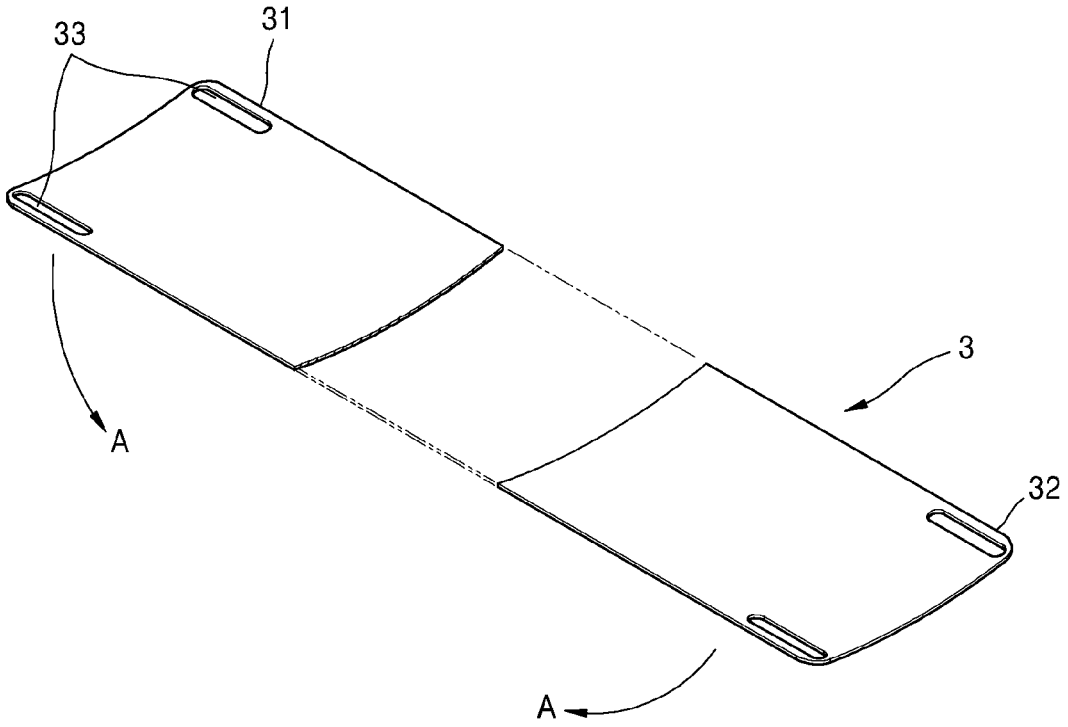
FIG. 10A and FIG. 10B each show perspective views of a bistable spring in a flat state and an annularly bent state.
Figure 10B:
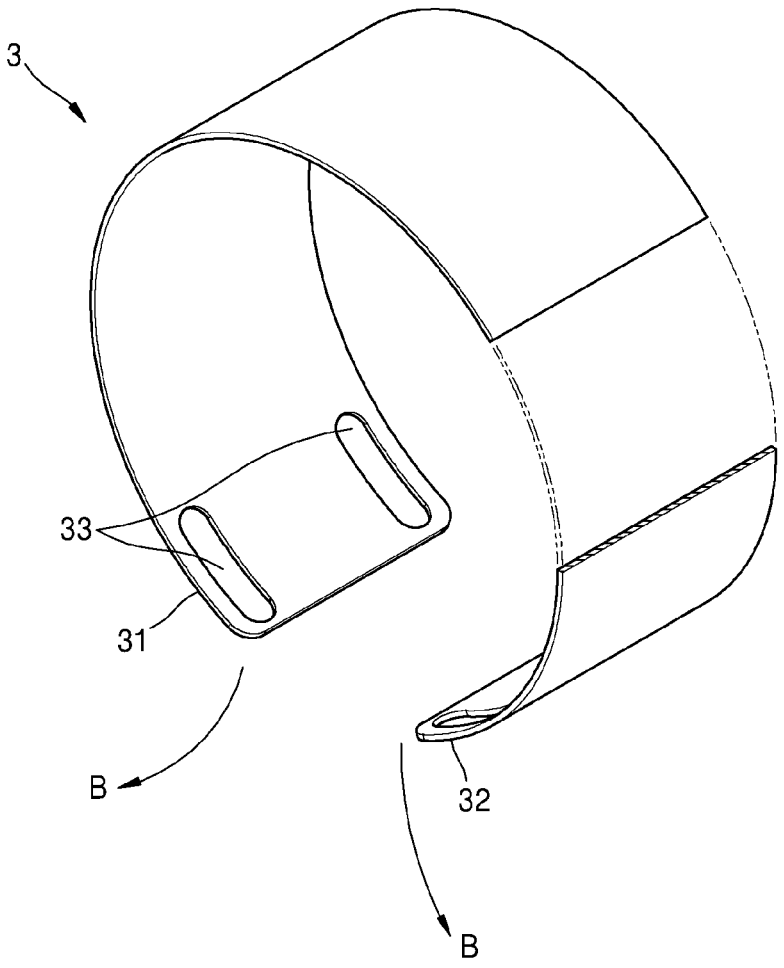
Figure 10C:
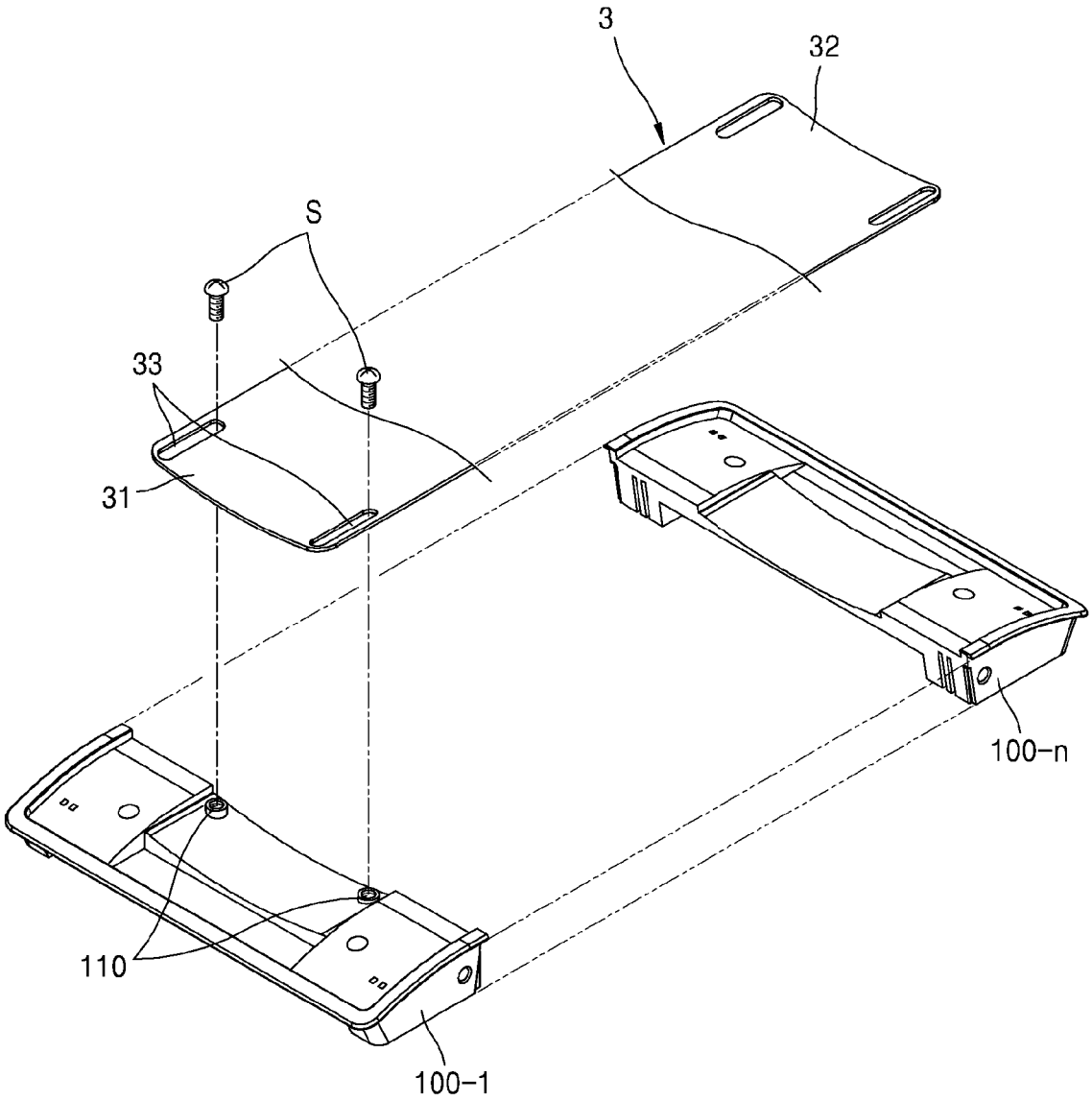
FIG. 10C is a perspective view showing an embodiment of a connection between a bistable spring and a body.
Figure 10D:
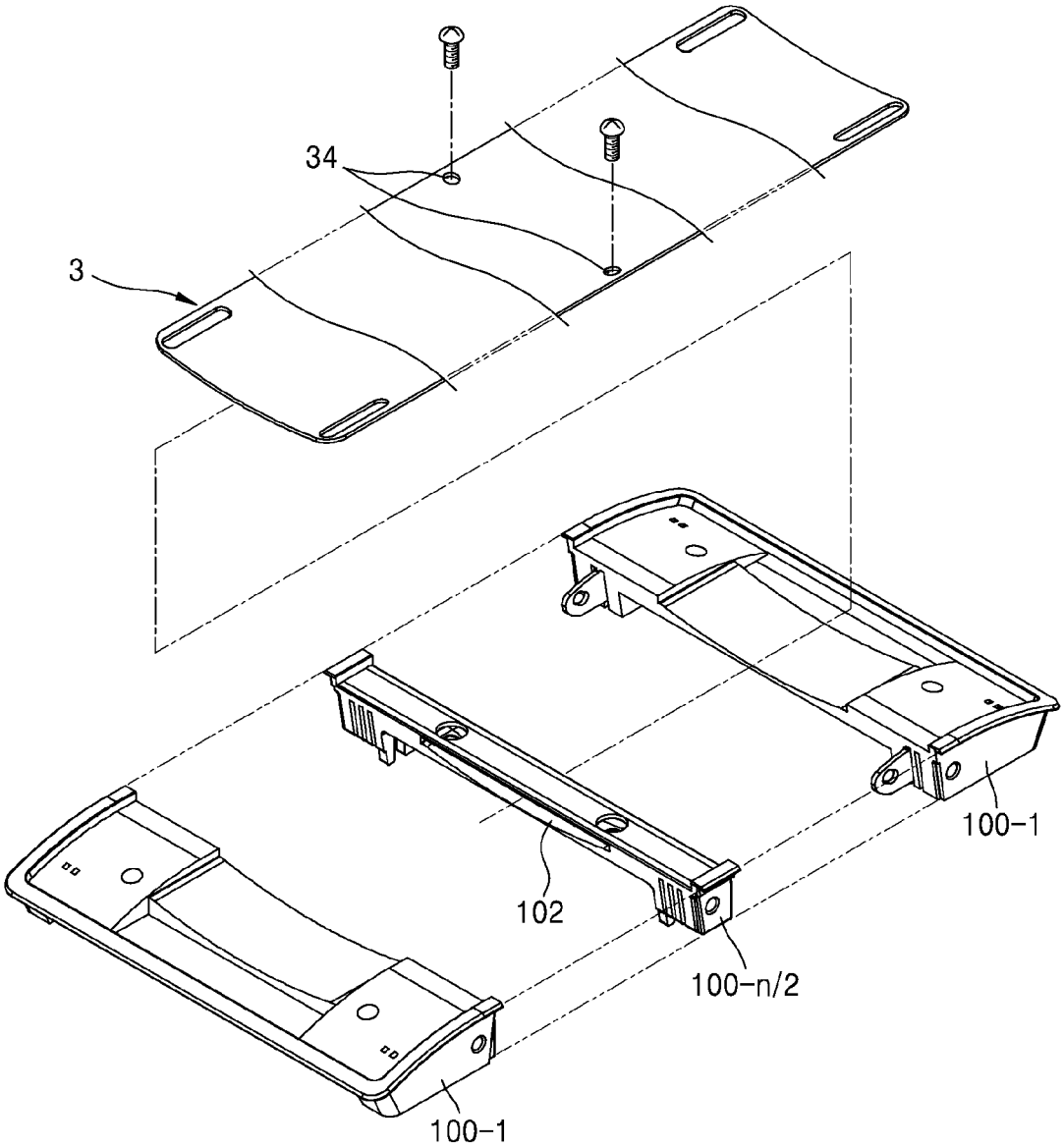
FIG. 10D is a perspective view showing another embodiment of a connection between a bistable spring and a body.

FIG. 10A and FIG. 10B each show perspective views of the bistable spring 3 in a flat state and a bent state into a ring. FIG. 10C is a perspective view showing an embodiment of a connection between the bistable spring 3 and the body 1 and FIG. 10D is a perspective view showing another embodiment of a connection between a bistable spring and the body 1.

The bistable spring 3 is supported by the plurality of segment members 310 to provide elasticity in a direction to which the body 1 is annularly bent and retentivity in which the body 1 maintains a flat state.

Referring to FIG. 10A, a cross-section in a width direction of the bistable spring 3 in a flat state maintains a gentle downward curvature. In this regard, when force in the width direction to an arrow A direction is applied to the bistable spring 3 to change the direction of a curvature of the cross-section, the bistable spring 3 may abruptly bend into a ring shape as illustrated in FIG. 10B. In this regard, the cross-section in the width direction of the bistable spring 3 may be flat or curved in a direction opposite to the state illustrated in FIG. 10A. When force is applied in an arrow B direction to the bistable spring 3 in the state illustrated in FIG. 10B to gradually unfold the bistable spring 3, the bistable spring 3 abruptly unfolds as soon as the direction of curvature in the width direction changes, such that the bistable spring 3 transforms into a completely flat state as illustrated in FIG. 10A.

The bistable spring 3 has one end 31 and the other end 32 respectively connected to a segment member 310-1 and a segment member 310-*n*. In the present embodiment, the bistable spring 3 has one end 31 and the other end 32 respectively connected to a top cover 100-1 and a top cover 100-*n*, as illustrated in FIG. 10C. As illustrated in FIG. 7, the top cover 100 may have a through slot 102, through which the bistable spring 3 passes. The bistable spring 3 passes through the through slots 102 of the plurality of top covers 100 and one end 31 and the other end 32 of the bistable spring 3 are connected to the top cover 100-1 and the top cover 100-*n*, respectively. Accordingly, the body 1 may transform between the flat state illustrated in FIG. 2 and the annularly bent state illustrated in FIG. 3, and the body 1 may be maintained each state. Although the length of the neutral line 25 of the flexible display device 2 does not change during unfolding of the body 1 and bending into a ring shape, internal and external lengths of the body 1 based on the neutral line 25 may change. Accordingly, at least one of the one end 31 and the other end 32 of the bistable spring 3 may be a free end. Also, the bistable spring 3 may be fixed on any one of the top covers 100-1 to **100-*n*. The bistable spring 3 may have a slot 33, which is cut in the length direction L, provided at any one of one end 31 and the other end 32, wherein the top cover 100-1 and the top cover 100-*n* are connected through the slot 33. For example, referring to FIG. 10C, an insertion protrusion 110 inserted into the slot 33 provided at one end 31 of the bistable spring 3, is provided on the top cover 100-1, wherein a fastening member S may be locked into the insertion protrusion 110 thereby the insertion protrusion 110 being movable along the slot 33. In this case, another end 32 of the bistable spring 3 may not be fixed on the top cover 100-*n*. Also, another end 32 of the bistable spring 3 may be fixed on the top cover 100-*n*** by using the fastening member S, such as a screw or the like.

The coupling between the top cover **100-*n* and another end 32 of the bistable spring 3 may be an adjustable coupling in the length direction L. For example, although not shown in the drawings, the insertion protrusions 110 are provided on the top covers 100-1 and 100-*n* as illustrated in FIG. 10C, the slots 33 may be provided on each of one end 31 and another end 32 of the bistable spring 3, and lock screws S may be locked into the insertion protrusions 110 through the slots 33, to thereby adjustably couple one end 31 and another end 32 of bistable spring 3 to the top covers 100-1 and 100-*n*** in the length direction L.

In one or more embodiments above, a case in which the bistable spring 3 is coupled to the top covers 100-1 and **100-*n*, which are disposed on the outermost portion I the length direction L, has been described, but the scope of embodiments not limited thereto. As long as at least one of one end 31 and another end 32 of the bistable spring 3 is adjustable in the length direction L, the bistable spring 3 may be coupled to one of the plurality of top covers 100. In other words, as illustrated in FIG. 10D, through holes 34 are provided at the center of the bistable spring 3 in the length direction L and the bistable spring 3 may be coupled with the top cover (100-*n*/2) through the through holes 34**.

Figure 11A:
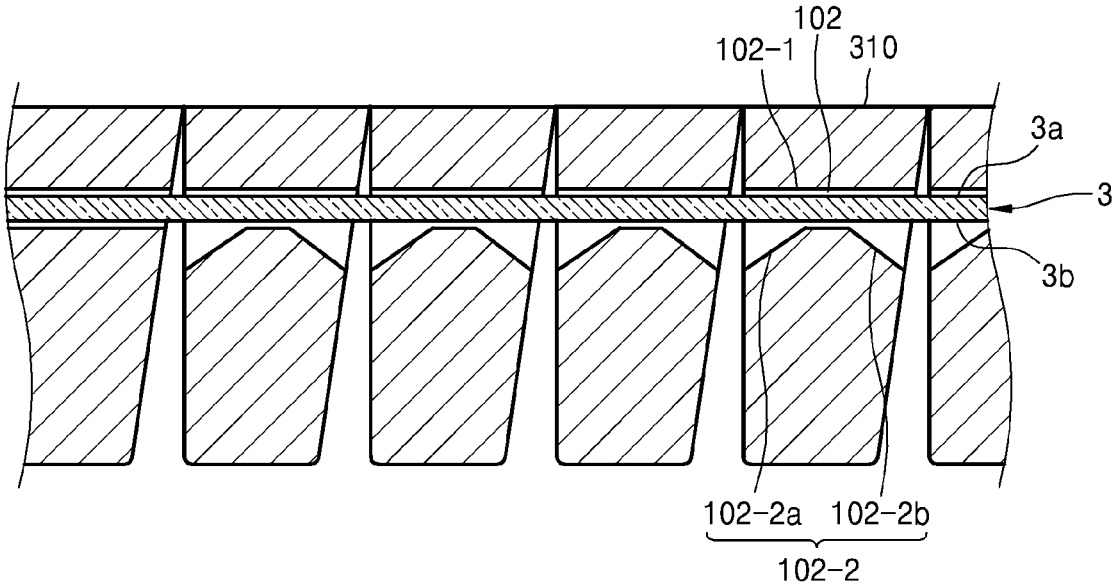
FIG. 11A is a cross-sectional view of a body in a flat state, which shows an embodiment of a through slot.
Figure 11B:
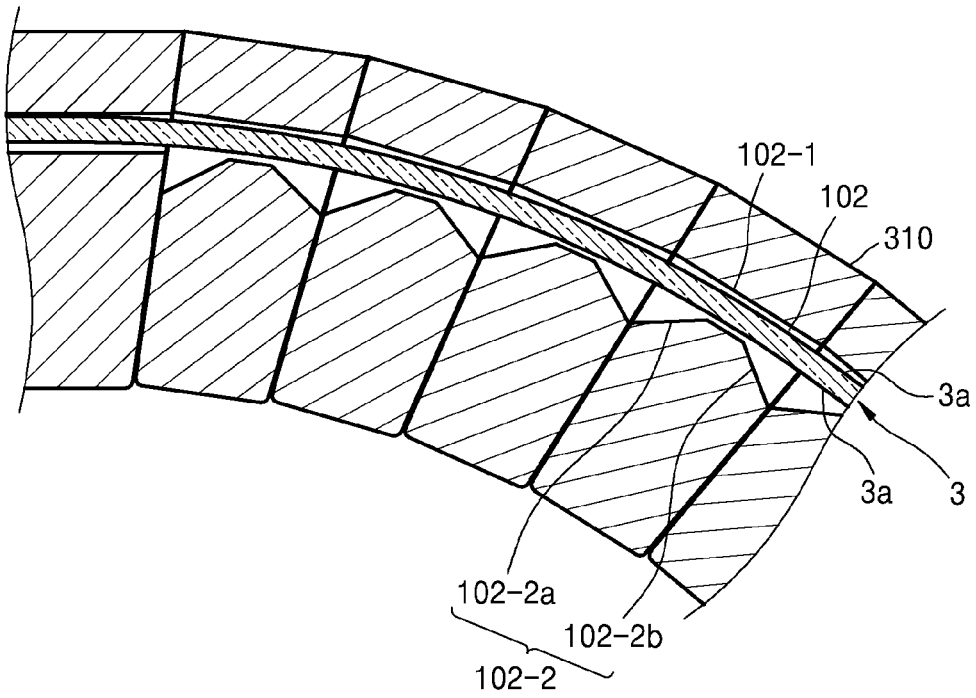
FIG. 11B is a cross-sectional view of the body in an annularly bent state, which shows an embodiment of a through slot.
Figure 11C:
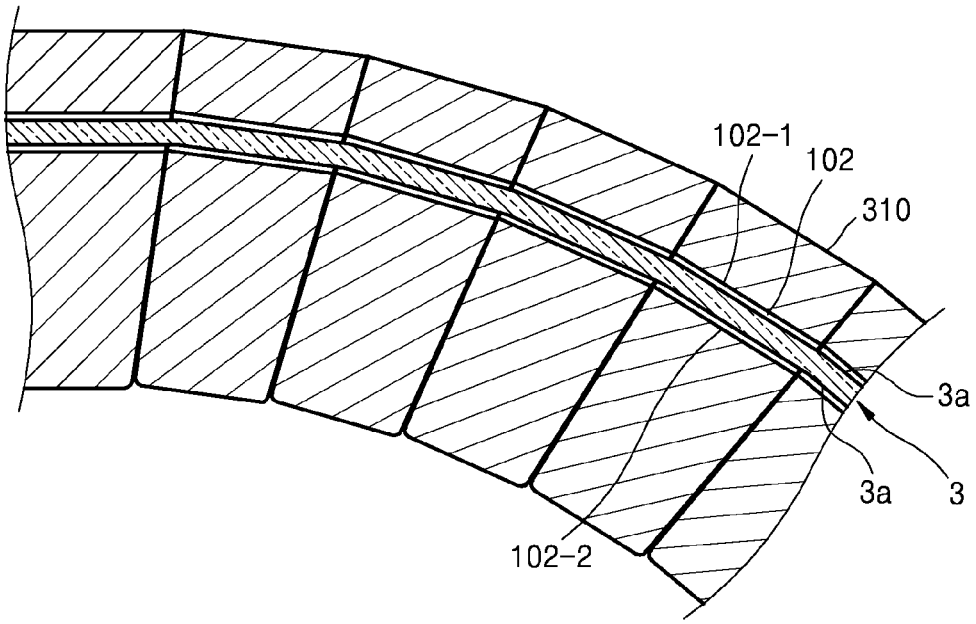
FIG. 11C is a cross-sectional view of a body in an annularly bent state, which shows a Comparative Example of a through slot.

FIG. 11A shows an embodiment of the through slot 102, which is a cross-sectional view of the body 1 in a flat state; FIG. 11B shows an embodiment of the through slot 102, which is a cross-sectional view of the body 1 in an annularly bent state; and FIG. 11C is a cross-sectional view of the body 1 in an annularly bent state, which shows a Comparative Example of a through slot.

Referring to FIGS. 11A and 11B, the through slot 102 includes a top supporting portion 102-1 and a bottom supporting portion 102-2, which respectively support a top portion **3*a* and a bottom portion 3*b* of the bistable spring 3. The top supporting portion 102-1 is an outer side in a bending direction, and the bottom supporting portion 102-2 is an inner side in the bending direction. A gap between the top supporting portion 102-1 and the bottom supporting portion 102-2 along an alignment direction of the segment members 310, in other words, a gap along the length direction L, is greater at both ends than a center portion. For example, the bottom supporting portion 102-2 may include inclination supporting portions 102-2*a* and 102-2*b* that extends from both ends to the center portion in the alignment direction of the segment members 300 and are upwardly inclined towards the top supporting portion 102-1. When a gap between the top supporting portion 102-1 and the bottom supporting portion 102-2 is uniform, the bistable spring 3 may bend at the end of the through slot 102 when the body 1 bends, as illustrated in FIG. 11C. According to an embodiment, due to the presence of the inclination supporting portions 102-2*a* and 102-2*b*, in which a gap between the bottom supporting portion 102-2 and the top supporting portion 102-1 of the through slot 102 increases from the center portion to both ends, the bistable spring 3 may naturally bend into a ring shape. Accordingly, the snapping of the bistable spring 3** may be prevented.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims.

What is claimed is:

1. A wearable device that is configured for transformation between an annularly bent state and a flat state, the wearable device comprising:

a plurality of segment members comprising a top portion and a bottom portion;

a plurality of connecting members that are disposed to correspond to the plurality of segment members, wherein each of the plurality of connecting members is connected to be mutually rotatable with two segment members disposed respectively on both sides thereof;

a bistable spring that is supported on the plurality of segment members to provide elasticity in a direction into the annularly bent state and retentivity maintaining the flat state; and a flexible display device that is supported on the top portion of the plurality of segment members.

2. The wearable device of claim 1, wherein:

each of the plurality of segment members comprises a connecting pin, and each of the plurality of connecting members comprises:

a center hole in which the connecting pin of a corresponding reference segment member among the plurality of segment members is inserted; and first and second guide slots in which connecting pins of two rotational segment members among the plurality of segment members disposed next to the reference segment member are inserted, wherein the first and second guide slots guide bottom portions of the two rotational segment members to be rotated in approaching/separating directions with respect to the bottom portion of the reference segment member.

3. The wearable device of claim 2, wherein the first and second guide slots have an arc shape in which a center thereof is located on a neutral line of the flexible display device.

4. The wearable device of claim 2, wherein:

each of the plurality of segment members comprises:

an extended portion that is inwardly stepped from an external surface of the segment member and extends to be overlapped with a neighboring segment member disposed one side of the segment member; and a sunken portion that is disposed on an opposite side of the extended portion and is sunken from an internal surface of the segment member to receive an extended portion of another neighboring segment member disposed on the other side of the segment member.

5. The wearable device of claim 4, wherein:

each of the plurality of segment members comprises:

a top cover in which the top portion and the connecting pin are provided, wherein the connecting member is coupled with the top cover; and a bottom cover in which the bottom portion, the extended portion, and the sunken portion are provided, wherein the bottom portion is coupled with the top cover.

6. The wearable device of claim 1, wherein at least one of one end and the other end of the bistable spring is a free end.

7. The wearable device of claim 6, wherein at least one of the one end and the other end of the bistable spring is adjustably connected to a corresponding segment member in a length direction.

8. The wearable device of claim 6, wherein the bistable spring is fixed on any one of the plurality of segment members.

9. The wearable device of claim 6, wherein the plurality of segment members comprise a slot through which the bistable spring passes.

10. The wearable device of claim 9, wherein:

the slot comprises a top supporting portion and a bottom supporting portion, which respectively support a top portion and a bottom portion of the bistable spring, and a gap between the top supporting portion and the bottom supporting portion of the slot is greater at both ends than a center portion in an alignment direction of the plurality of the segment members.

11. The wearable device of claim 10, wherein the bottom supporting portion of the slot includes inclination supporting portions that extend from both ends to the center portion in the alignment direction of the segment members and are upwardly inclined towards the top supporting portion.

12. A wearable device comprising:

a body including a plurality of segment members that are connected sequentially to be rotatable, wherein the body transforms between an annularly bent state and a flat state;

a flexible display device supported on the body;

a bistable spring that provides elasticity in a direction of bending into the annularly bent state and retentivity to maintain the flat state; and slots provided in the plurality of segment members to pass the bitable spring therethrough, wherein the slots comprise a top supporting portion and a bottom supporting portion, each of which supports a top surface and a bottom surface of the bistable spring;

wherein a gap between the top supporting portion of the slot and the bottom supporting portion of the slot is greater at both ends than a center portion in an alignment direction of the plurality of segment members.

13. The wearable device of claim 12, wherein the bottom supporting portion of the slot includes inclination supporting portions that extends from both ends to the center portion in the alignment direction of the segment members and are upwardly inclined towards the top supporting portion of the slot.

14. The wearable device of claim 13, wherein at least one of one end and the other end of the bistable spring is a free end.

15. The wearable device of claim 14, wherein:

each of the plurality of segment members comprises a top portion and a bottom portion that is shorter than the top portion, and the plurality of segment members are rotatable in a direction in which bottom portions of the segment members approach/separate.

16. The wearable device of claim 15, the wearable device further comprising:

a plurality of connecting members that are disposed to correspond to the plurality of segment members, wherein each of the plurality of segment members is connected to be mutually rotatable with two segment members disposed respectively on both sides thereof, wherein each of the plurality of segment members comprises a connecting pin, and wherein each of the plurality of connecting members comprises:

a center hole in which the connecting pin of a corresponding reference segment member among the plurality of segment members is inserted; and first and second guide slots in which connecting pins of two rotational segment members among the plurality of segment members disposed next to the reference segment member are inserted, wherein the first and second guide slots guide bottom portions of the two rotational segment members to be rotated in approaching/separating directions with respect to the bottom portion of the reference segment member.

17. The wearable device of claim 16, wherein the first and second guide slots have an arc shape in which a center thereof is located on a neutral line of the flexible display device.

18. The wearable device of claim 12, wherein each of the plurality of segment members comprises:

an extended portion that is inwardly stepped from an external surface of the segment member and extends to be overlapped with a neighboring segment member disposed one side of the segment member; and a sunken portion that is disposed on an opposite side of the extended portion and is sunken from an internal surface of the segment member to receive an extended portion of another neighboring segment member disposed on the other side of the segment member.

19. A wearable device comprising:

a body including a plurality of segment members that are connected sequentially to be rotatable, wherein the body transforms between an annularly bent state and a flat state;

a flexible flat member supported on the body;

a bistable spring that provides elasticity in a direction of bending into the annularly bent state and retentivity to maintain the flat state; and slots provided in the plurality of segment members to pass the bitable spring therethrough, wherein the slots comprise a top supporting portion and a bottom supporting portion, each of which supports a top surface and a bottom surface of the bistable spring;

wherein a gap between the top supporting portion of the slot and the bottom supporting portion of the slot is greater at both ends than a center portion in an alignment direction of the plurality of segment members.

20. The wearable device of claim 19, wherein the wearable device is one of a communication device, a game device, a multimedia device, a portable computer, or an imaging device.

* * * * *